US009022017B2

(12) United States Patent
Hyun et al.

(10) Patent No.: US 9,022,017 B2
(45) Date of Patent: May 5, 2015

(54) OVEN

(75) Inventors: Jong Hak Hyun, Seoul (KR); Jae Man Joo, Suwon-si (KR); Jong Chull Shon, Suwon-si (KR); Ki Suk Jeon, Seongnam-si (KR); Myoung Keun Kwon, Seoul (KR); Tae Woo Kim, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 122 days.

(21) Appl. No.: 12/929,926

(22) Filed: Feb. 24, 2011

(65) Prior Publication Data

US 2011/0214661 A1 Sep. 8, 2011

(30) Foreign Application Priority Data

Mar. 2, 2010 (KR) ..... 10-2010-0018626

(51) Int. Cl.
*F24C 15/32* (2006.01)
*F24C 15/00* (2006.01)
*F24C 15/04* (2006.01)

(52) U.S. Cl.
CPC ..... *F24C 15/006* (2013.01); *F24C 15/04* (2013.01)

(58) Field of Classification Search
USPC ..... 126/21 A, 1 R, 21 R, 198, 190
See application file for complete search history.

(56) References Cited

U.S. PATENT DOCUMENTS

2007/0131220 A1* 6/2007 Kim et al. ..... 126/273 R
2008/0184984 A1 8/2008 Elkasevic

FOREIGN PATENT DOCUMENTS

CN 1985605 A 6/2007
DE 10349313 A1 * 5/2005
EP 0 549 933 A1 7/1993
EP 1 793 174 A2 6/2007
EP 1 956 302 A2 8/2008
EP 1 972 855 A1 9/2008
KR 10-2007-0061980 6/2007
KR 10-2007-0108298 11/2007

OTHER PUBLICATIONS

European Search Report dated Jan. 31, 2011 in corresponding European Patent Application 11153307.1.

(Continued)

*Primary Examiner* — Kenneth Rinehart
*Assistant Examiner* — Jason Lau
(74) *Attorney, Agent, or Firm* — Staas & Halsey LLP

(57) ABSTRACT

An oven having enhanced cooling efficiency. The oven includes a cooking chamber, a door to open or close a front side of the cooking chamber, a cooling fan located above the cooking chamber to suction and blow outside air, a discharge duct to discharge the air, blown by the cooling fan, forward of the door, a plurality of flow-paths defined in the door to allow outside air to be introduced into and moved in the flow-path in association with discharge of the air through the discharge duct, and a suction pipe to connect at least one of the flow-paths and the cooling fan to each other. Suction force of the cooling fan is applied to the flow-paths of the door through the suction pipe as well as the interior of an electric machine room, allowing the air in the flow-path to be discharged to the outside through the suction pipe and the discharge duct. This assures more active air movement in the door and maximizes the cooling effect of the door.

14 Claims, 6 Drawing Sheets

(56) References Cited

OTHER PUBLICATIONS

Chinese Office Action issued Apr. 22, 2014 in corresponding Chinese Application No. 201110048150.6.

Korean Notice of Allowance dated Nov. 14, 2014 in corresponding Korean Patent Application No. 10-2010-0018626.

* cited by examiner

OVEN

CROSS-REFERENCE TO RELATED APPLICATIONS

This application claims the benefit of Korean Patent Application No. 2010-0018626, filed on Mar. 2, 2010 in the Korean Intellectual Property Office, the disclosure of which is incorporated herein by reference.

BACKGROUND

1. Field

Embodiments relate to an oven to enhance cooling efficiency.

2. Description of the Related Art

Generally, an oven is a cooking appliance designed to cook food using dry heat in a closed cooking chamber. Ovens may be classified, e.g., into electric ovens and gas ovens according to a heat source. The heat source serves to heat a closed space, i.e. the cooking chamber of the oven to a high-temperature. A door is provided at a front side of the oven to close the cooking chamber. That is, the door serves to prevent emission of heat, enabling food cooking at a high-temperature.

If heat of the cooking chamber is directly transmitted to the door, the door becomes hot and may cause a user to be burnt. Thus, it may be necessary to cool the door. Conventionally, door cooling has been implemented as air is circulated through an air flow-path defined in the door by convection.

However, the above described door cooling method may entail deteriorated cooling efficiency because the quantity of cold air circulating through the flow-path of the door is not great.

SUMMARY

Therefore, it is one aspect to provide an oven having enhanced door cooling efficiency.

It is another aspect to provide an oven to suction and discharge stationary air within a door.

Additional aspects will be set forth in part in the description which follows and, in part, will be apparent from the description, or may be learned by practice of the invention.

In accordance with one aspect, an oven includes a cooking chamber in which food is cooked, a door to open or close a front side of the cooking chamber, a cooling fan located above the cooking chamber to suction and blow outside air, a discharge duct to discharge the air, blown by the cooling fan, forward of the door, a flow-path defined in the door to allow outside air to be introduced into and moved in the flow-path in association with discharge of the air through the discharge duct, and a suction pipe connecting the flow-path and the cooling fan to each other to allow a part of the air moving in the flow-path to be suctioned toward the cooling fan.

The suction pipe may include a first suction pipe provided in the door and a second suction pipe to communicate the first suction pipe and the cooling fan with each other.

The door may include a door frame defining a framework, and the first suction pipe may be vertically placed in either lateral portion of the door frame.

The first suction pipe may include a slit vertically perforated in a side surface thereof to allow the air to be introduced into the slit.

The first suction pipe may include a first pipe opening formed at an upper end thereof to communicate with the second suction pipe, and the second suction pipe may include a second pipe opening facing the first pipe opening.

The door may include a plurality of glass panels installed to the door frame to define a plurality of flow-paths, and the slit may be arranged at a side of at least one of the plurality of flow-paths.

The plurality of glass panels may include front and rear glass panels arranged respectively at front and rear sides of the door frame, and two intermediate glass panels arranged between the front glass panel and the rear glass panel, the plurality of flow-paths may include a front flow-path for air movement between the front glass panel and the neighboring intermediate glass panel, a rear flow-path for air movement between the rear glass panel and the neighboring intermediate glass panel, and an intermediate flow-path for air movement between the two intermediate glass panels, and the slit may be arranged between the two intermediate glass panels to allow the air moving in the intermediate flow-path to be introduced into the slit.

In accordance with another aspect, an oven includes a cooking chamber, a door to open or close the cooking chamber, a door frame defining a framework of the door, a plurality of glass panels installed to the door frame to define a plurality of flow-paths for air movement, a cooling fan to suction and blow air, and a suction pipe having one end communicating with at least one of the plurality of flow-paths and the other end communicating with the cooling fan to enable air movement.

The suction pipe may include a first suction pipe embedded in either lateral portion of the door frame and a second suction pipe arranged in an electric machine room above the cooking chamber to communicate the first suction pipe and the cooling fan with each other.

The first suction pipe may include a slit vertically perforated in a side surface thereof to suction air moving in at least one of the plurality of flow-paths.

The plurality of glass panels may include front and rear glass panels arranged respectively at front and rear sides of the door frame, and two intermediate glass panels arranged between the front glass panel and the rear glass panel, the plurality of flow-paths may include a front flow-path for air movement between the front glass panel and the neighboring intermediate glass panel, a rear flow-path for air movement between the rear glass panel and the neighboring intermediate glass panel, and an intermediate flow-path for air movement between the two intermediate glass panels, and the slit may be arranged between the two intermediate glass panels to allow the air moving in the intermediate flow-path to be introduced into the slit.

The first suction pipe may include a first pipe opening formed at an upper end thereof to communicate with the second suction pipe, and the second suction pipe may include a second pipe opening facing the first pipe opening.

In accordance with a further aspect, an oven includes a cooking chamber, a door to open or close a front side of the cooking chamber, a cooling fan located above the cooking chamber to suction and blow outside air, a discharge duct to discharge the air, blown by the cooling fan, forward of the door, a plurality of flow-paths defined in the door to allow outside air to be introduced from the bottom and moved to the top in the flow-paths in association with discharge of the air through the discharge duct, and a suction pipe to suction the air from at least one of the plurality of flow-paths using suction force of the cooling fan.

The suction pipe may include a first suction pipe provided in a door frame of the door and a second suction pipe to communicate the first suction pipe and the cooling fan with each other.

The first suction pipe may include a slit vertically perforated in a side surface thereof to allow the air to be introduced into the slit.

The plurality of flow-paths may be defined by a plurality of glass panels installed to the door frame, and the slit may be arranged at a side of at least one of the plurality of flow-paths.

The plurality of glass panels may include front and rear glass panels arranged respectively at front and rear sides of the door frame, and two intermediate glass panels arranged between the front glass panel and the rear glass panel, the plurality of flow-paths may include a front flow-path for air movement between the front glass panel and the neighboring intermediate glass panel, a rear flow-path for air movement between the rear glass panel and the neighboring intermediate glass panel, and an intermediate flow-path for air movement between the two intermediate glass panels, and the slit may be arranged between the two intermediate glass panels to allow the air moving in the intermediate flow-path to be introduced into the slit.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
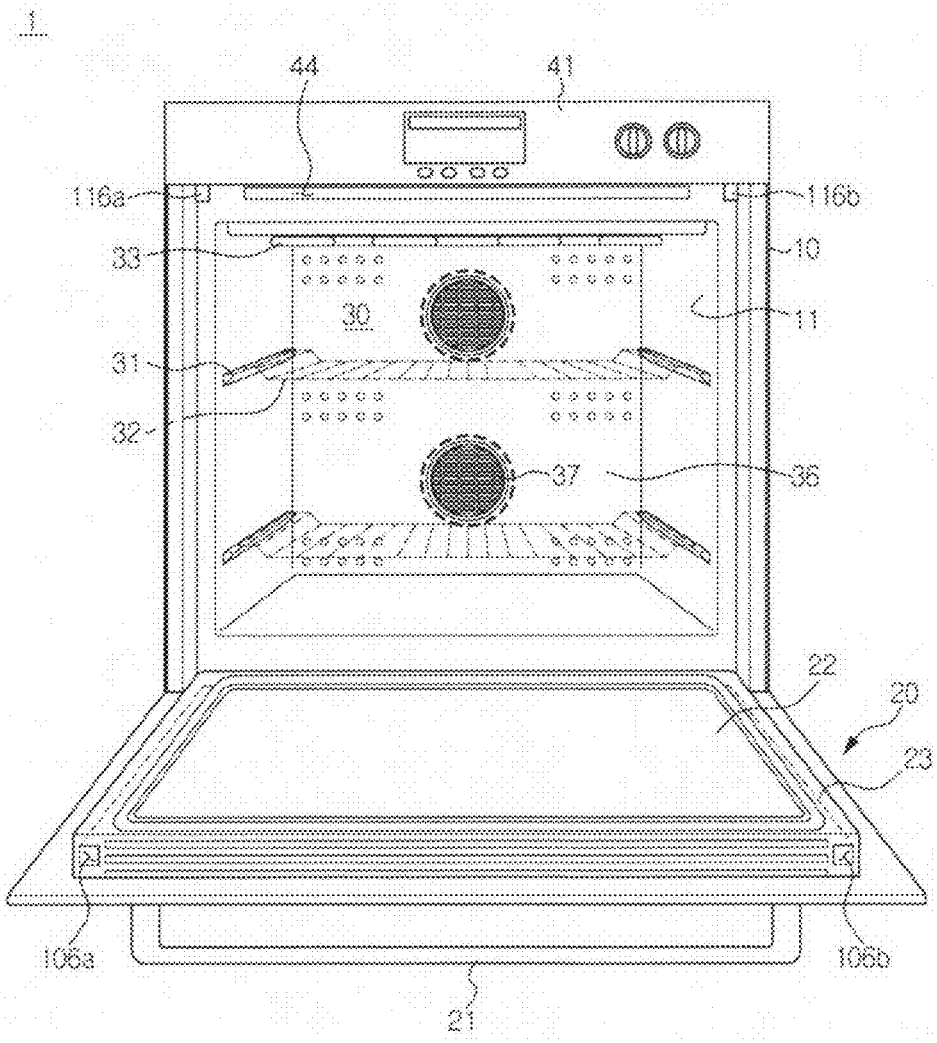
FIG. 1 is a perspective view illustrating an oven according to an embodiment.

Reference will now be made in detail to an embodiment, examples of which are illustrated in the accompanying drawings, wherein like reference numerals refer to like elements throughout.

Figure 2:
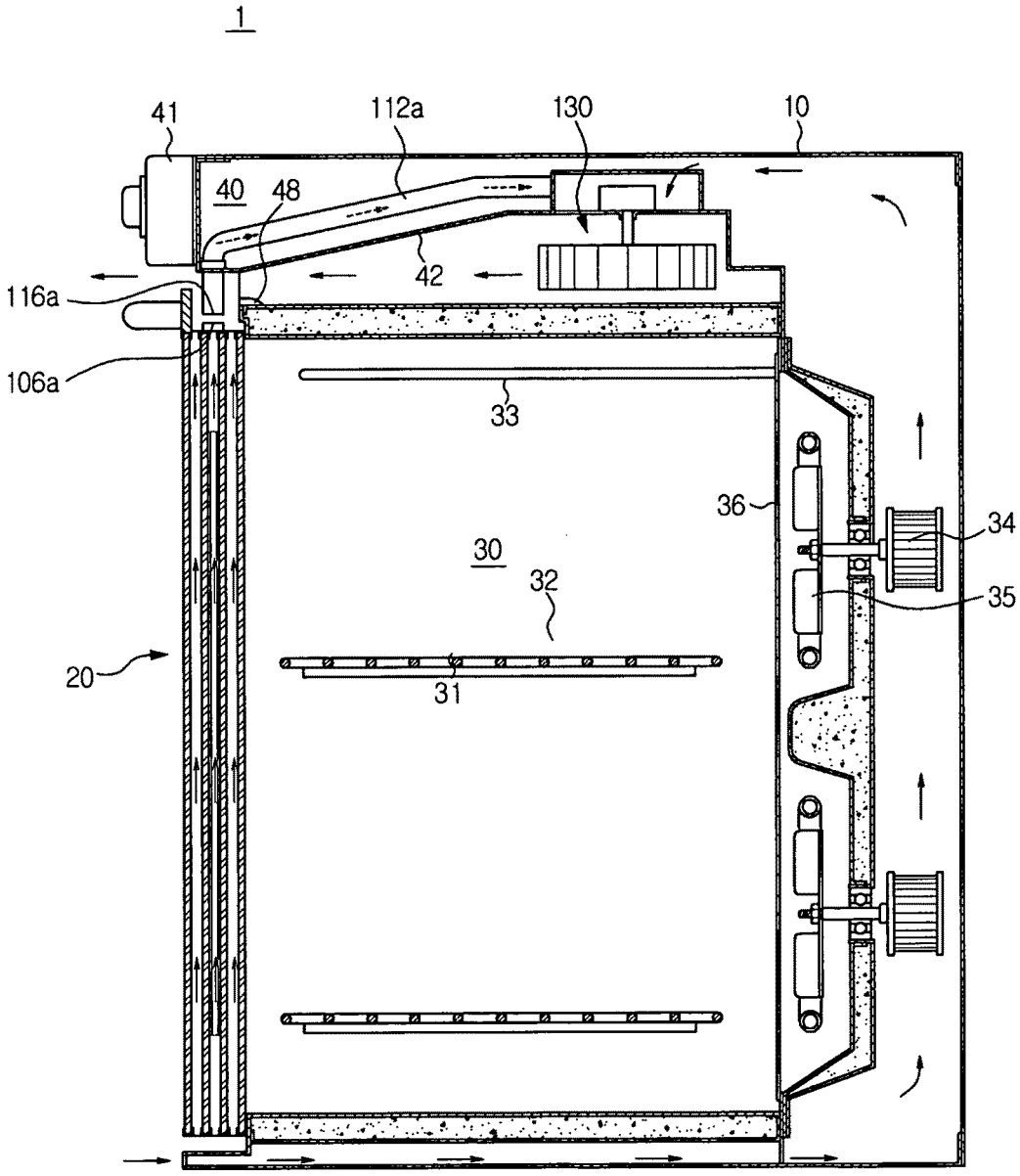
FIG. 2 is a side sectional view of the oven according to the embodiment.

FIG. 1 is a perspective view illustrating an oven according to an embodiment, and FIG. 2 is a side sectional view of the oven according to the embodiment.

As illustrated in FIGS. 1 and 2, the oven 1 according to the embodiment includes a box-shaped outer case 10 having a front opening, a box-shaped inner case 11 placed in the outer case 10 and having a front opening similar to the outer case 10, a door 20 hingedly coupled to a lower end of the inner case 11 to open or close the front opening of the inner case 11, and a handle 21 provided at an outer surface of the door 20 to allow a user to easily open or close the door 20.

The inner case 11 internally defines a cooking chamber 30. The cooking chamber 30 is provided at moderate positions of inner lateral surfaces thereof with a plurality of guide rails 31 to assure simplified attachment/detachment of racks 32. A heater 33 is mounted close to the ceiling of the cooking chamber 30 to heat and cook food placed on the racks 32. A circulation motor 34 and a circulation fan 35 are mounted in a rear region of the cooking chamber 30, and serve to achieve a uniform temperature throughout the cooking chamber 30 via circulation of interior air while enabling rapid cooking. A fan cover 36 in the form of a flat plate is provided in front of the circulation fan 35. The fan cover 36 is perforated with circular holes 37.

An electric machine room 40, in which electric elements, such as a circuit board (not shown), etc., are mounted, is provided above the cooking chamber 30. Also, a control panel 41 having buttons and a display window is provided at an upper portion of a front surface of the outer case 10, to allow the user to select a cooking method and to control a cooking time and process, etc.

The electric elements mounted in the electric machine room 40 exhibit poor heat resistance and therefore, it may be necessary to discharge hot interior air of the electric machine room 40 to the outside and suction cold outside air into the electric machine room 40. To this end, the electric machine room 40 is provided with a discharge duct 42 and a cooling fan 130, to suction air from the outside of the oven 1 and discharge the air forward of the oven 1. The air of the discharge duct 42 is discharged through an opening 44 provided between the outer case 10 and the inner case 11.

The discharge duct 42 is fastened to an upper surface of the inner case 11 by means of screws. The discharge duct 42 fastened to the inner case 11 defines an air flow-path in the form of a venturi tube that is gradually narrowed from the rear to the front. In addition, the upper surface of the inner case 11 is formed with a protrusion 48 having a predetermined height to further narrow a front end region of the flow-path. With this configuration, when the air passes through the opening 44 provided at a front end of the discharge duct 42, the velocity of the air is relatively raised, thus causing a relatively lowered pressure. That is, the top of the door 20 has a pressure lower than the bottom of the door 20.

Hereinafter, cooling of the door 20 will be described in detail.

Figure 3:
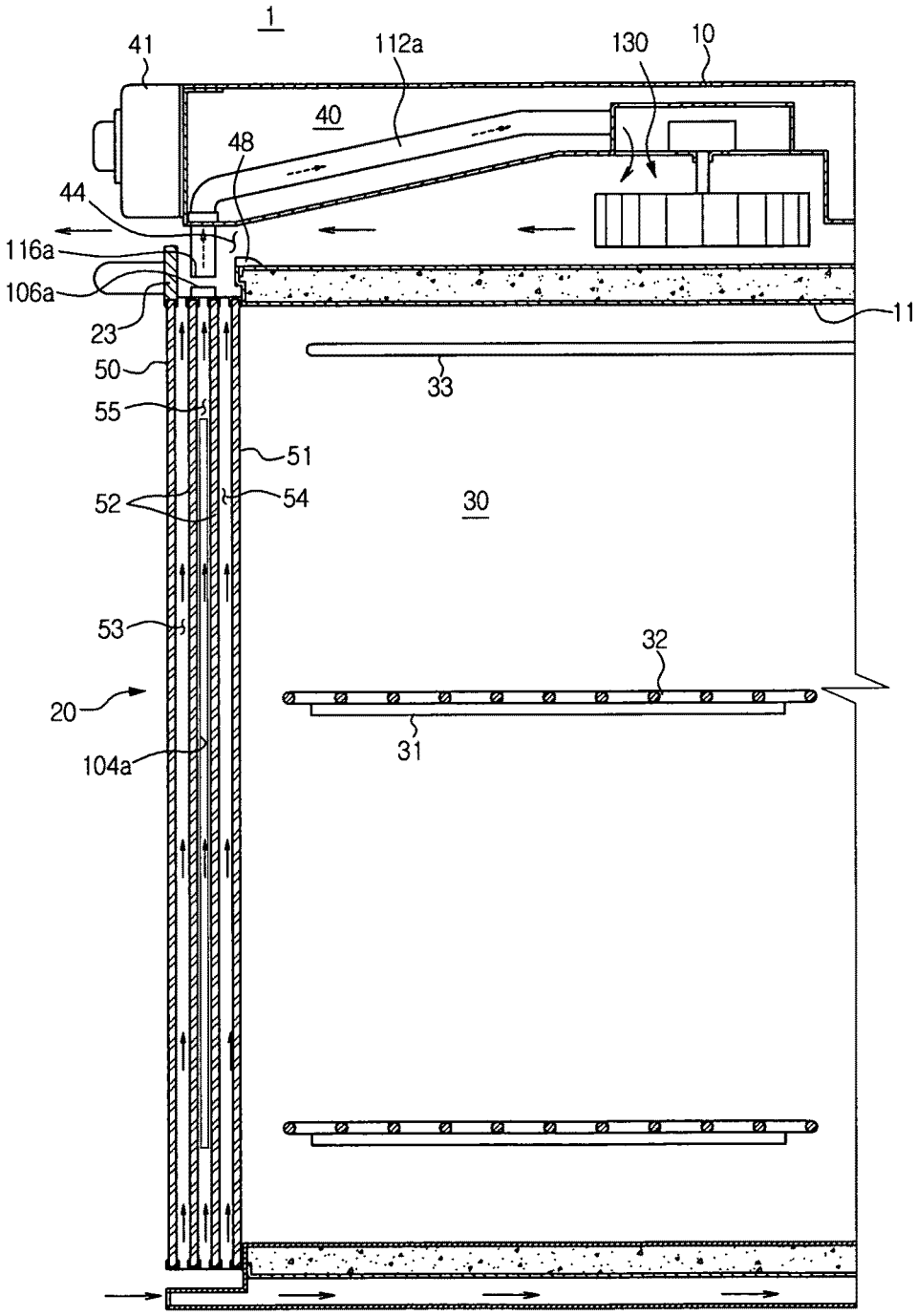
FIG. 3 is a detailed side sectional view of FIG. 2 illustrating the door in detail.
Figure 4:
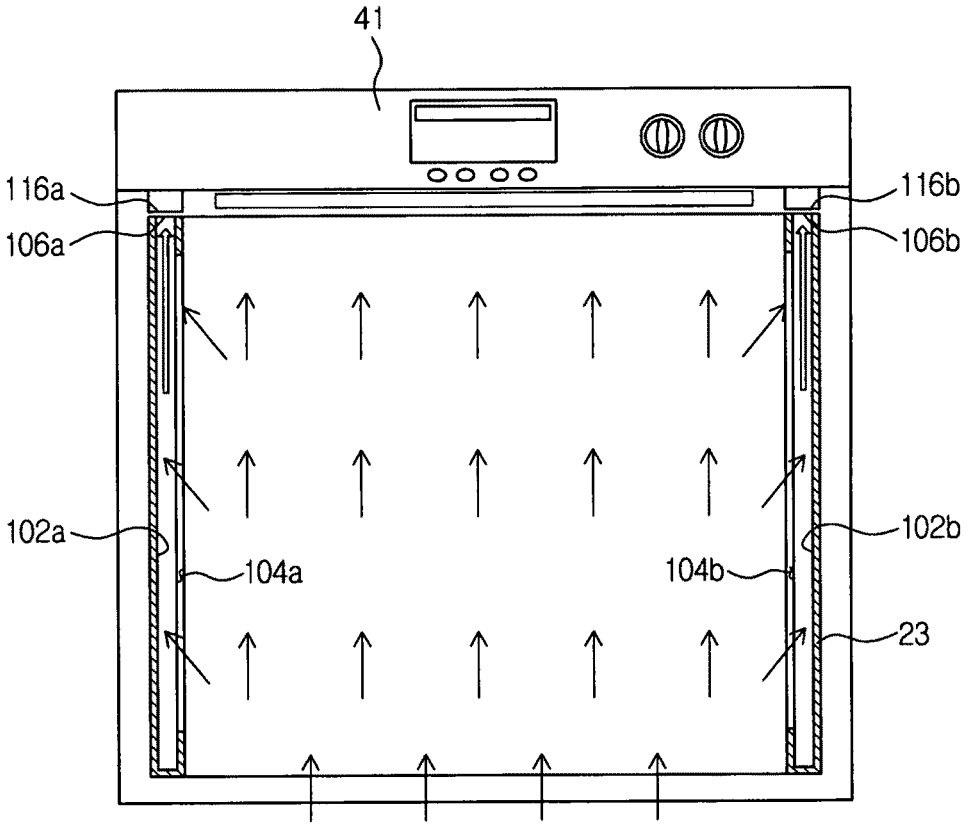
FIG. 4 is a front view illustrating the interior of the door.
Figure 5:
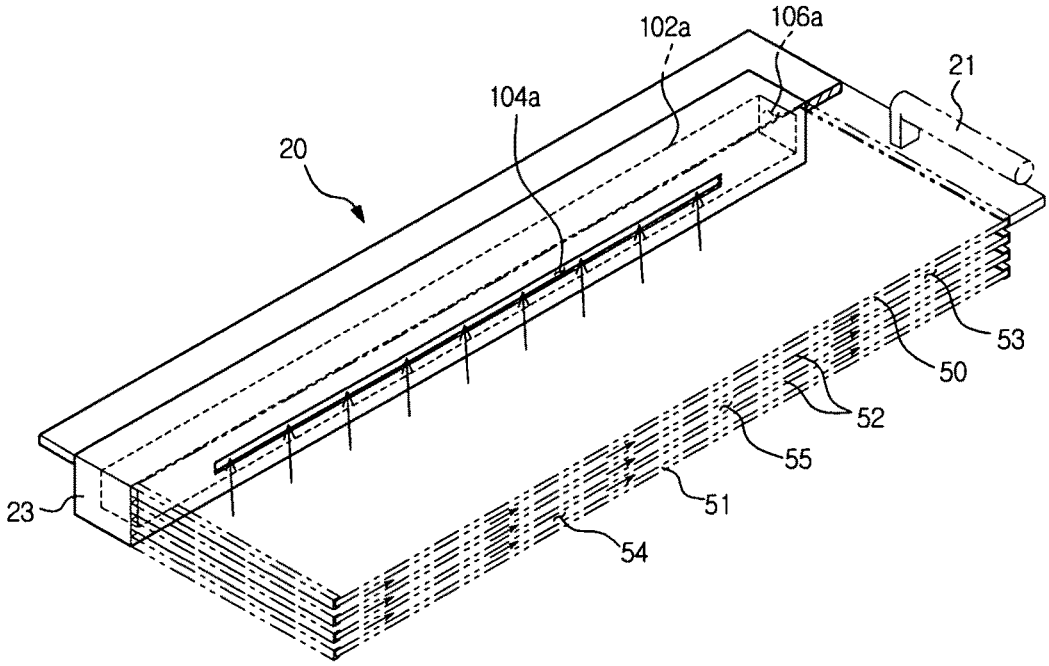
FIG. 5 is a cut-away perspective view of the door.
Figure 6:
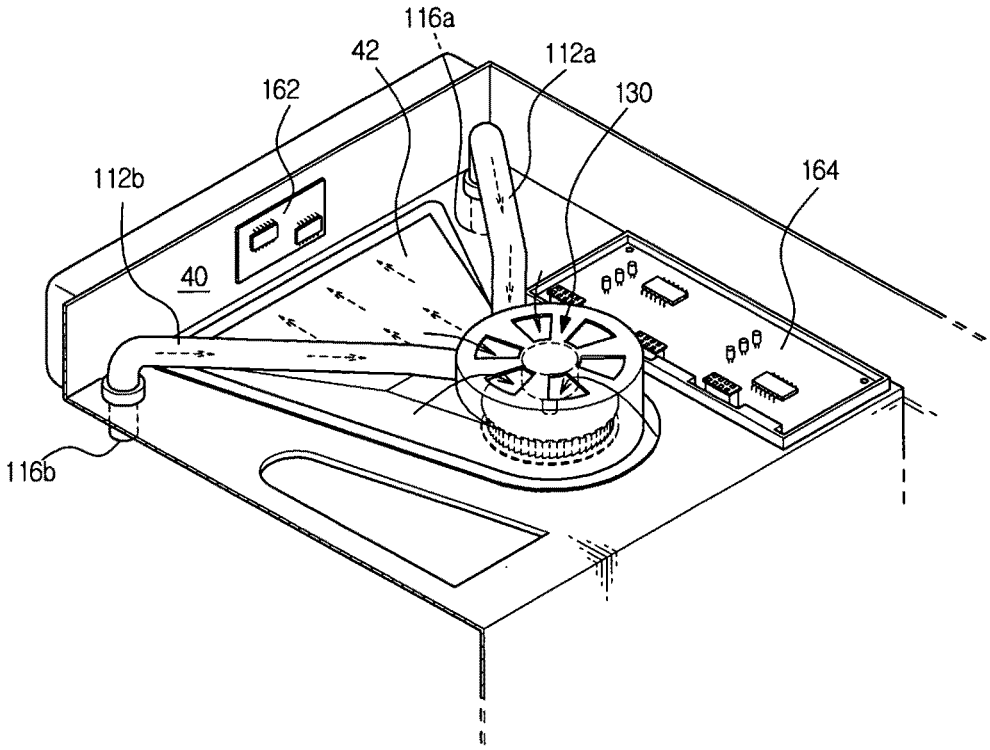
FIG. 6 is a perspective view illustrating the interior of an electric machine room.

FIG. 3 is a detailed side sectional view of FIG. 2 illustrating the door in detail, FIG. 4 is a front view illustrating the interior of the door, FIG. 5 is a cut-away perspective view of the door, and FIG. 6 is a perspective view illustrating the interior of the electric machine room.

As illustrated in FIGS. 3 to 5, the door 20 includes a door frame 23 defining a framework, a front glass panel 50 fitted to a front side of the door frame 23, a rear glass panel 51 fitted to a rear side of the door frame 23, and two intermediate glass panels 52 between the front glass panel 50 and the rear glass panel 51. In this case, a flow-path defined between the front glass panel 50 and the neighboring intermediate glass panel 52 is referred to as a front flow-path 53, and a flow-path defined between the rear glass panel 51 and the neighboring intermediate glass panel 52 is referred to as a rear flow-path 54. Also, an intermediate flow-path 55 is defined between the neighboring two intermediate glass panels 52.

In the front flow-path 53, the rear flow-path 54 and the intermediate flow-path 55 defined by the plurality of door glass panels 50, 51 and 52, the air moves from the bottom to the top by a pressure difference between the top and bottom of the door 20. Accordingly, the air absorbs heat transmitted from the cooking chamber 30 while moving, more particularly, from the bottom to the top, between the plurality of door glass panels 50,51 and 52, so as to emit the heat to the outside. In conclusion, the plurality of door glass panels, i.e. the four door glass panels 50, 51, and 52 define the front flow-path 53, the rear flow-path 54 and the intermediate flow-path 55, thereby accomplishing cooling of the door 20.

In the embodiment, a pair of first suction pipes 102*a* and 102*b* is provided in opposite lateral portions of the door frame 23 to allow the air to move in a vertical direction. The first suction pipes 102*a* and 102*b* are obtained by allowing air to move in opposite interior spaces of a conventional door frame.

The first suction pipes 102*a* and 102*b* respectively have slits 104*a* and 104*b* perforated in a side surface thereof for air suction. The slits 104*a* and 104*b* have a narrow width and extend vertically along the side surface of the first suction pipes 102*a* and 102*b*. In the embodiment of the present invention, the slits 104*a* and 104*b* are arranged between the two intermediate glass panels 52 to allow the air moving in the intermediate flow-path 55 to be introduced into the slits 104*a* and 104*b*. Suction of the air moving in the intermediate flow-path 55 serves to maximize cooling efficiency. More specifically, if the air moving in the rear flow-path 54 is suctioned into the slits 104*a* and 104*b*, excessive cooling occurs, thus causing deterioration in cooking performance of the oven 1 because the rear flow-path 54 is located closest to the cooking chamber 30. On the other hand, the front flow-path 53 exhibits lesser heat transfer from the cooking chamber 30 than the intermediate flow-path 53, thus having a low need for cooling. Accordingly, it may be most appropriate to enhance cooling efficiency by suctioning the air moving in the intermediate flow-path 55. However, the arrangement position of the slits 104*a* and 104*b* is not limited to the above description, and the slits 104*a* and 104*b* may be arranged at a side of the front flow-path 53 or the rear flow-path 54 to suction the air moving in the corresponding flow-path. In addition, the slits 104*a* and 104*b* may be arranged at a side of two or more ones of the front flow-path 53, the intermediate flow-path 55 and the rear flow-path 54, to enhance cooling efficiency.

The first suction pipes 102*a* and 102*b* respectively have first pipe openings 106*a* and 106*b* formed at upper ends thereof to communicate with second suction pipes 112*a* and 112*b* that will be described hereinafter. That is, the air suctioned from the intermediate flow-path 55 first moves through the first suction pipes 102*a* and 102*b*, and then, moves into the second suction pipes 112*a* and 112*b* through the first pipe openings 106*a* and 106*b*.

As illustrated in FIG. 6, the second suction pipes 112*a* and 112*b* are arranged in the electric machine room 40. The second suction pipes 112*a* and 112*b* are provided at one end thereof with second pipe openings 116*a* and 116*b* to communicate with the first suction pipes 102*a* and 102*b*, and the other end of the second suction pipes 112*a* and 112*b* communicates with the cooling fan 130. With this configuration, suction force generated by rotation of the cooling fan 130 is transmitted to the first suction pipes 102*a* and 102*b* by way of the second suction pipes 112*a* and 112*b*, thereby being used to suction the air moving in the intermediate flow-path 55. That is, the first suction pipes 102*a* and 102*b* and the second suction pipes 112*a* and 112*b* serve as suction pipes to suction the air of the intermediate flow-path 55.

The cooling fan 130 is located in the discharge duct 42. Suction force generated by rotation of the cooling fan 130 has an effect on the interior air of the electric machine room 40 as well as the second suction pipes 112*a* and 112*b*. More specifically, rotation of the cooling fan 130 enables suction of the interior air of the electric machine room 40 and the air of the intermediate flow-path 55 through the second suction pipes 112*a* and 112*b* and the first suction pipes 102*a* and 102*b*, thereby allowing the air to be discharged forward of the oven 1 through the discharge duct 42. By allowing even the interior air of the electric machine room 40 to be discharged and circulated, the electric elements, such as a display substrate 162, main substrate 164, etc., received in the electric machine room 40 may be cooled.

Hereinafter, a cooling operation of the oven 1 according to the embodiment of the present invention will be described.

If the user actuates the oven 1 by operating the control panel 41 to cook food, the cooling fan 130 is rotated to cool the oven 1.

With rotation of the cooling fan 130, the interior air of the discharge duct 42 is discharged to the outside through the front opening 44 of the discharge duct 42. Simultaneously, the air moves from the bottom to the top in the plurality of flow-paths 53, 54 and 55 defined in the door 20 due to the Venturi effect. As the air having passed through the flow-paths 53, 54 and 55 is discharged forward of the oven 1 along with the interior air of the discharge duct 42, cooling of the door 20 is accomplished.

As suction force generated by rotation of the cooling fan 130 is applied to the first suction pipes 102*a* and 102*b* and the second suction pipes 112*a* and 112*b*, the air of the intermediate flow-path 55 in the vicinity of the slits 104*a* and 104*b* of the first suction pipes 102*a* and 102*b* is suctioned into the slits 104*a* and 104*b*. The air having passed through the slits 104*a* and 104*b* is suctioned into the discharge duct 42 by way of the first suction pipes 102*a* and 102*b* and the second suction pipes 112*a* and 112*b*, and then, is discharged forward of the oven 1 through the opening 44 of the discharge duct 42 along with the air suctioned from the interior of the electric machine room 40.

By suctioning the air of the intermediate flow-path 55 through the first suction pipes 102*a* and 102*b* and the second suction pipes 112*a* and 112*b*, more active circulation of the air in the door 20 may be accomplished. This increases the introduction amount of outside cold air, maximizing the cooling effect.

As is apparent from the above description, an oven according to an embodiment is configured to suction and discharge a part of air moving in a door, achieving enhanced door cooling efficiency.

Further, realizing smooth air movement within the door may increase the quantity of cold air to be introduced into the door.

Furthermore, the enhanced door cooling efficiency may be accomplished even by a minimum increase in manufacturing costs as a result of adopting most of a conventional oven configuration.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An oven comprising:

a cooking chamber in which food is cooked;

a door to open or close a front side of the cooking chamber;

a cooling fan located above the cooking chamber to suction and blow outside air;

a discharge duct to discharge the air, blown by the cooling fan, forward of the door;

a flow-path defined in the door to allow outside air to be introduced into and moved in the flow-path, in association with discharge of the air through the discharge duct; and a suction pipe connecting the flow-path and the cooling fan to each other to allow a part of the air moving in the flow-path to be suctioned toward the cooling fan, wherein the suction pipe includes a first suction pipe provided in the door and a second suction pipe to communicate the first suction pipe and the cooling fan with each other, wherein air is suctioned from the flow-path defined in the door, and then through the first suction pipe, and then through the second suction pipe, and then to the cooling fan, and wherein a part of the air moving in the flow-path defined in the door is suctioned through the first suction pipe and the second suction pipe and introduced into the cooling fan, and a remaining part of the air moving in the flow-path is discharged to an opening in the front of the door due to the Venturi effect produced by air discharged through the cooling fan, without flowing through the first suction pipe, the second suction pipe, and the cooling fan.

2. The oven according to claim 1, wherein:

the door includes a door frame defining a framework; and the first suction pipe is vertically placed in either lateral portion of the door frame.

3. The oven according to claim 2, wherein the first suction pipe includes a slit vertically perforated in a side surface thereof to allow the air to be introduced into the slit.

4. The oven according to claim 3, wherein the first suction pipe includes a first pipe opening formed at an upper end thereof to communicate with the second suction pipe, and the second suction pipe includes a second pipe opening facing the first pipe opening.

5. The oven according to claim 3, wherein:

the door includes a plurality of glass panels installed to the door frame to define a plurality of flow-paths; and the slit is arranged at a side of at least one of the plurality of flow-paths.

6. The oven according to claim 5, wherein:

the plurality of glass panels includes front and rear glass panels arranged respectively at front and rear sides of the door frame, and two intermediate glass panels arranged between the front glass panel and the rear glass panel;

the plurality of flow-paths includes a front flow-path for air movement between the front glass panel and the neighboring intermediate glass panel, a rear flow-path for air movement between the rear glass panel and the neighboring intermediate glass panel, and an intermediate flow-path for air movement between the two intermediate glass panels; and the slit is arranged between the two intermediate glass panels to allow the air moving in the intermediate flow-path to be introduced into the slit.

7. An oven comprising:

a cooking chamber;

a door to open or close the cooking chamber;

a door frame defining a framework of the door;

a plurality of glass panels installed to the door frame to define a plurality of flow-paths for air movement;

a cooling fan to suction and blow air; and a suction pipe having one end communicating with at least one of the plurality of flow-paths and the other end communicating with the cooling fan to enable air movement, wherein the suction pipe includes a first suction pipe embedded in either lateral portion of the door frame and a second suction pipe arranged in an electric machine room above the cooking chamber to communicate the first suction pipe and the cooling fan with each other, wherein air is suctioned from the flow-path defined in the door, and then through the first suction pipe, and then through the second suction pipe, and then to the cooling fan, and wherein a part of the air moving in the plurality of flow-paths defined in the door is suctioned through the first suction pipe and the second suction pipe and introduced into the cooling fan, and a remaining part of the air moving in the plurality of flow-paths is discharged to an opening in the front of the door due to the Venturi effect produced by air discharged through the cooling fan, without flowing through the first suction pipe, the second suction pipe, and the cooling fan.

8. The oven according to claim 7, wherein the first suction pipe includes a slit vertically perforated in a side surface thereof to suction air moving in at least one of the plurality of flow-paths.

9. The oven according to claim 8, wherein:

the plurality of glass panels includes front and rear glass panels arranged respectively at front and rear sides of the door frame, and two intermediate glass panels arranged between the front glass panel and the rear glass panel;

the plurality of flow-paths includes a front flow-path for air movement between the front glass panel and the neighboring intermediate glass panel, a rear flow-path for air movement between the rear glass panel and the neighboring intermediate glass panel, and an intermediate flow-path for air movement between the two intermediate glass panels; and the slit is arranged between the two intermediate glass panels to allow the air moving in the intermediate flow-path to be introduced into the slit.

10. The oven according to claim 7, wherein the first suction pipe includes a first pipe opening formed at an upper end thereof to communicate with the second suction pipe, and the second suction pipe includes a second pipe opening facing the first pipe opening.

11. An oven comprising:

a cooking chamber;

a door to open or close a front side of the cooking chamber;

a cooling fan located above the cooking chamber to suction and blow outside air;

a discharge duct to discharge the air, blown by the cooling fan, forward of the door;

a plurality of flow-paths defined in the door to allow outside air to be introduced from the bottom and moved to the top in the plurality of flow-paths, in association with discharge of the air through the discharge duct; and a suction pipe to suction the air from at least one of the plurality of flow-paths using suction force of the cooling fan, wherein the suction pipe includes a first suction pipe provided in a door frame of the door and a second suction pipe to communicate the first suction pipe and the cooling fan with each other, wherein air is suctioned from at least one of the plurality of flow-paths, and then through the first suction pipe, and then through the second suction pipe, and then to the cooling fan, and wherein a part of the air moving in the plurality of flow-paths is suctioned through the first suction pipe and the second suction pipe and introduced into the cooling fan, and a remaining part of the air moving in the plurality of flow paths is discharged to an opening in the front of the door due to the Venturi effect produced by air discharged through the cooling fan, without flowing through the first suction pipe, the second suction pipe, and the cooling fan.

12. The oven according to claim 11, wherein the first suction pipe includes a slit vertically perforated in a side surface thereof to allow the air to be introduced into the slit.

13. The oven according to claim 12, wherein:

the plurality of flow-paths is defined by a plurality of glass panels installed to the door frame; and the slit is arranged at a side of at least one of the plurality of flow-paths.

14. The oven according to claim 13, wherein:

the plurality of glass panels includes front and rear glass panels arranged respectively at front and rear sides of the door frame, and two intermediate glass panels arranged between the front glass panel and the rear glass panel;

the plurality of flow-paths includes a front flow-path for air movement between the front glass panel and the neighboring intermediate glass panel, a rear flow-path for air movement between the rear glass panel and the neighboring intermediate glass panel, and an intermediate flow-path for air movement between the two intermediate glass panels; and the slit is arranged between the two intermediate glass panels to allow the air moving in the intermediate flow-path to be introduced into the slit.

* * * * *